US009411273B1

(12) United States Patent
Takahashi

(10) Patent No.: US 9,411,273 B1
(45) Date of Patent: Aug. 9, 2016

(54) FIXING DEVICE AND IMAGE FORMING APPARATUS

(71) Applicant: KYOCERA Document Solutions Inc., Osaka (JP)

(72) Inventor: Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/857,960

(22) Filed: Sep. 18, 2015

(51) Int. Cl.
*G03G 15/20* (2006.01)

(52) U.S. Cl.
CPC ..... *G03G 15/2007* (2013.01)

(58) Field of Classification Search
CPC ..... G03G 15/2053; G03G 2215/2035; G03G 15/2039; G03G 15/2017; G03G 15/2042; G03G 15/2064; G03G 15/205; G03G 15/2078; G03G 15/2007; G03G 2215/2032; G03G 15/2085; G03G 15/2032
See application file for complete search history.

(56) References Cited

U.S. PATENT DOCUMENTS 8,983,353 B2 3/2015 Yoshiura et al.
2014/0016971 A1* 1/2014 Arai ..... G03G 15/2053 399/329

FOREIGN PATENT DOCUMENTS

JP 2012-128075 A 7/2012

* cited by examiner

*Primary Examiner* — Roy Y Yi
(74) *Attorney, Agent, or Firm* — Studebaker & Brackett PC

(57) ABSTRACT

A fixing device includes a fixing belt, a pressuring member, a heat source, a reflecting member, a supporting member and a retaining member. The pressuring member is configured to come into pressure contact with the fixing belt to form a fixing nip. The heat source is arranged at an inside in a radial direction of the fixing belt and configured to radiate a radiant heat. The reflecting member is configured to reflect the radiant heat radiated from the heat source to an inner circumference face of the fixing belt. The supporting member is configured to support the reflecting member from a side of the fixing nip. The retaining member includes a contact part and a holding part. The contact part is configured to come into contact with the reflecting member from a side opposite to the fixing nip. The holding part is configured to hold the heat source.

10 Claims, 11 Drawing Sheets

FIXING DEVICE AND IMAGE FORMING APPARATUS

INCORPORATION BY REFERENCE

This application is based on Japanese Patent application No. 2014-072991 filed on Mar. 31, 2014, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet. For the fixing device, a heat roller manner is widely used. The heat roller manner is a manner to form a fixing nip by using a pair of rollers, which are made of metal, such as aluminum or iron, for example.

On the other hand, a fixing manner is being shifted from the above-mentioned heat roller manner to a belt manner to shorten a warm-up time. The belt manner is a manner to form a fixing nip by using a fixing belt. The fixing belt has a smaller heat capacity than a pair of the rollers and is made of metal, such as SUS (stainless steel), for example.

For example, there is a fixing device including a fixing belt, a pressuring member coming into pressure contact with the fixing belt so as to form a fixing nip, a heat source arranged at an inside in a radial direction of the fixing belt, a reflecting member reflecting a radiant heat from the heat source and a supporting member supporting the reflecting member.

In the fixing device as described above, there is a case where the reflecting member and the supporting member are fastened to each other with a screw. However, if the reflecting member and the supporting member are fastened to each other with a screw, there is a problem that the weaker of the reflecting member and the supporting member (normally, the reflecting member) is deformed when they are heated, in a case where a linear expansion coefficient of the reflecting member is different from that of the supporting member.

Further, in the fixing device as described above, when the fixing device is assembled, the heat source, the reflecting member and the supporting member have to be inserted into the fixing belt which has flexibility. Therefore, there is a problem that it is difficult to assemble the fixing device.

SUMMARY

In accordance with an embodiment of the present disclosure, a fixing device includes a fixing belt, a pressuring member, a heat source, a reflecting member, a supporting member and a retaining member. The fixing belt is configured to be rotatable around a rotation axis. The pressuring member is configured to be rotatable and to come into pressure contact with the fixing belt so as to form a fixing nip. The heat source is arranged at an inside in a radial direction of the fixing belt and configured to radiate a radiant heat. The reflecting member is configured to reflect the radiant heat radiated from the heat source to an inner circumference face of the fixing belt. The supporting member is configured to support the reflecting member from a side of the fixing nip. The retaining member includes a contact part and a holding part. The contact part is configured to come into contact with the reflecting member from a side opposite to the fixing nip. The holding part is configured to hold the heat source.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
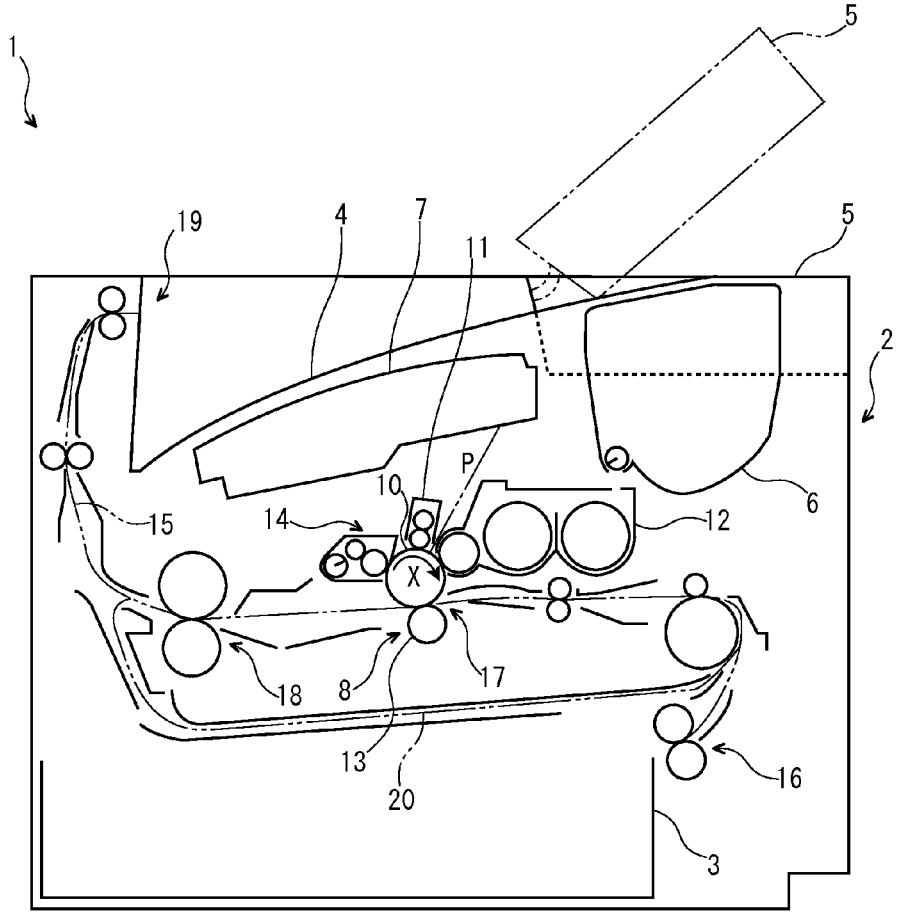
FIG. 1 is a schematic diagram showing an outline of a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner.

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, it will be described so that the front side of the fixing device 18 is positioned at the near side of FIG. 2, for convenience of explanation. An arrow Y of FIG. 2 a conveying direction of the sheet (in the present embodiment, left and right direction). Arrow Fr of each figure indicates a front side of the fixing device 18. An arrow I of each figure indicates an inside in a front and rear direction and an arrow O of each figure indicates an outside in the front and rear direction.

Figure 2:
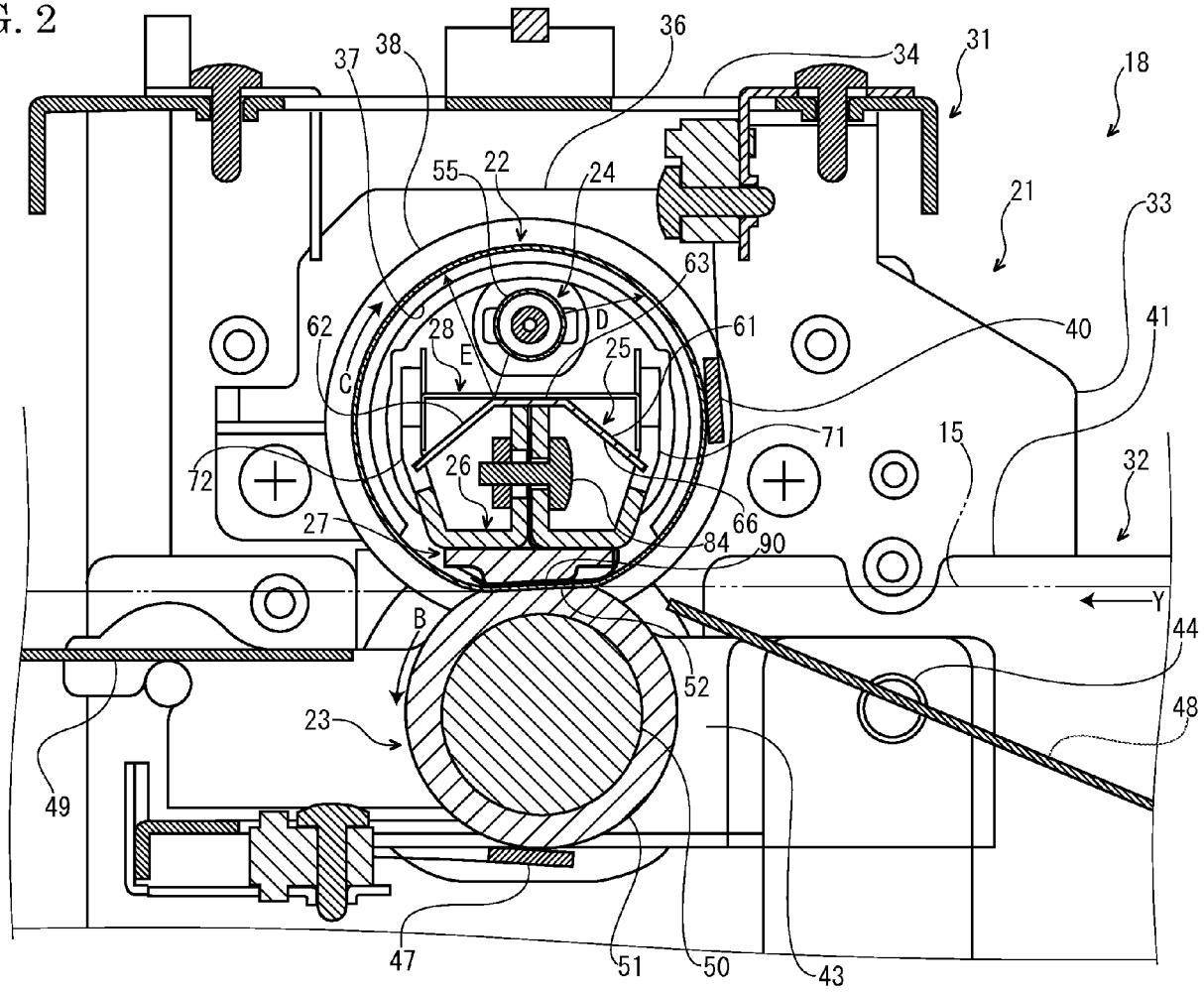
FIG. 2 is a sectional view showing a fixing device of the printer according to the embodiment of the present disclosure.

As shown in FIG. 2 or the like, the fixing device 18 includes a box-like formed fixing frame 21, a fixing belt 22 housed in an upper part of the fixing frame 21, a pressuring roller 23 (a pressuring member) housed in a lower part of the fixing frame 21, a heater 24 (a heat source) arranged at an inside of the fixing belt 22 in a radial direction, a reflecting member 25 arranged at the inside of the fixing belt 22 in the radial direction and at a lower side of the heater 24, a supporting member 26 arranged at the inside of the fixing belt 22 in the radial direction and at a lower side of the reflecting member 25, a pressing member 27 arranged at the inside of the fixing belt 22 in the radial direction and at a lower side of the supporting member 26 and retaining members 28 (In FIG. 2, only a rear side retaining member 28 is shown) respectively arranged at both front and rear end sides of the fixing belt 22.

Figure 3:
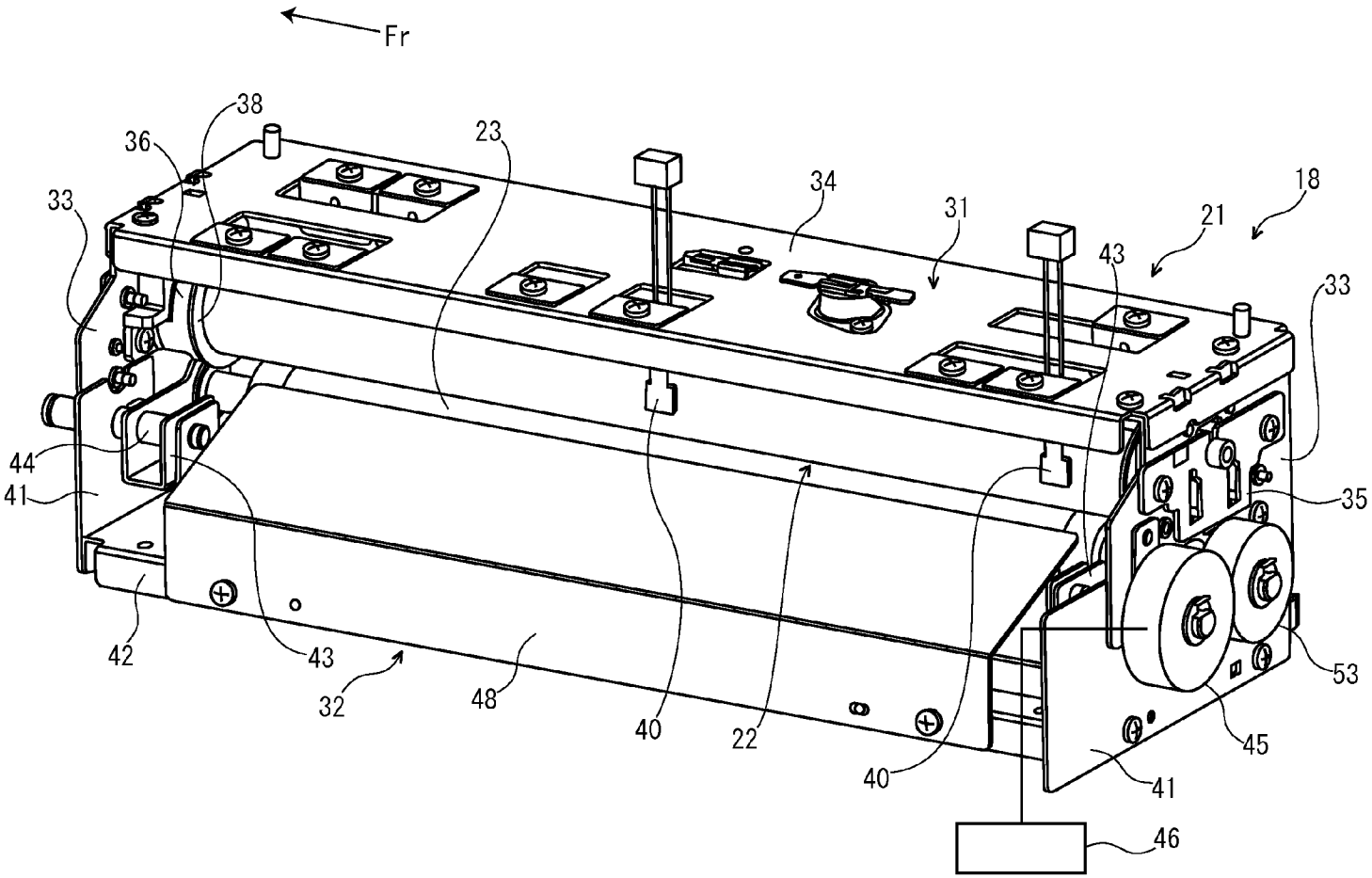
FIG. 3 is a perspective view showing the fixing device of the printer according to the embodiment of the present disclosure.

The fixing frame 21 is made of a plate metal. As shown in FIG. 3 or the like, the fixing frame 21 is composed of an upper frame part 31 and a lower frame part 32 connected to each other.

The upper frame part 31 of the fixing frame 21 includes a pair of front and rear upper side end plates 33 and a top plate 34 connecting upper end parts of the upper side end plates 33.

Figure 4:
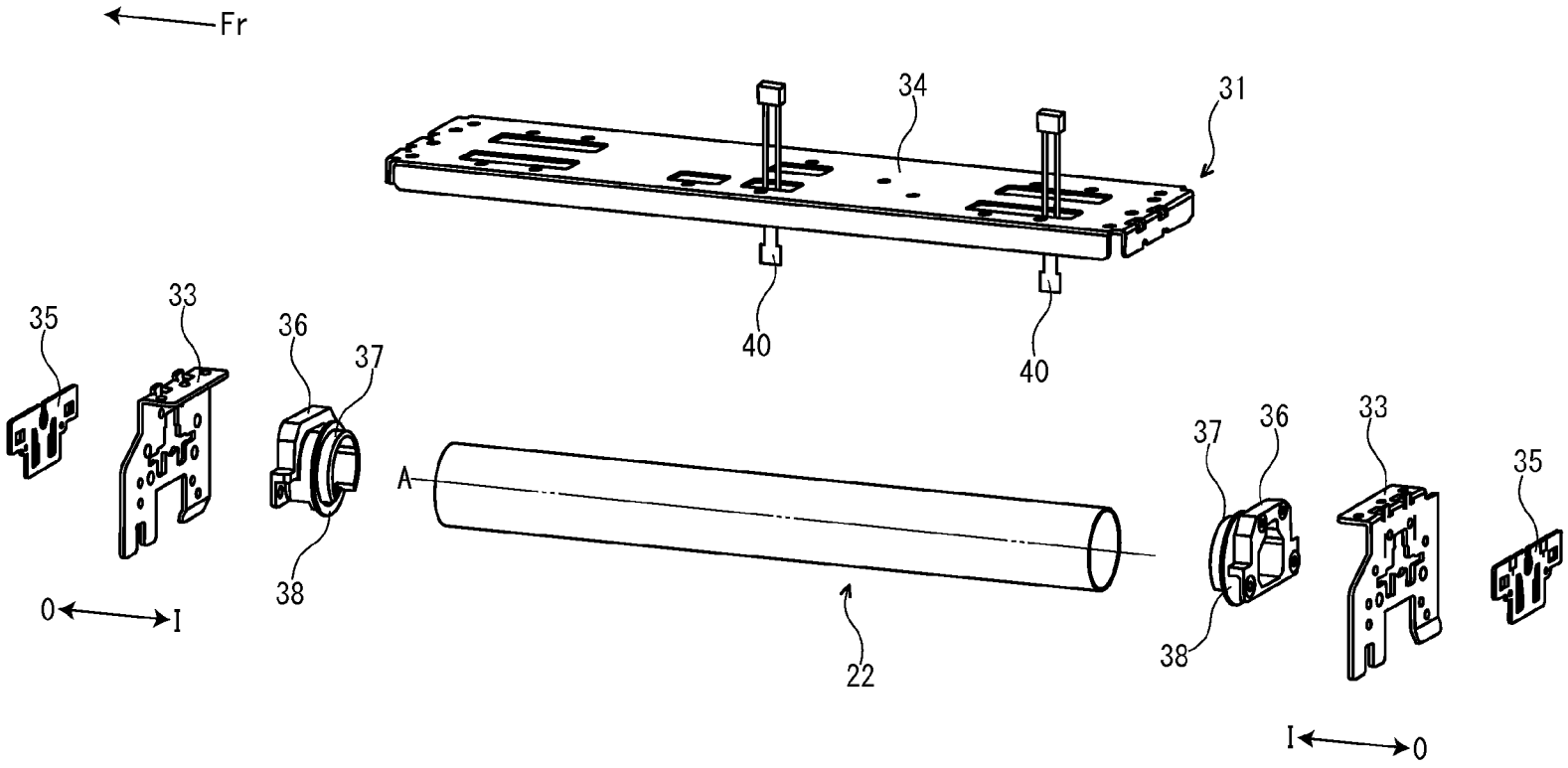
FIG. 4 is an exploded perspective view showing an upper frame part and a fixing belt, in the fixing device of the printer according to the embodiment of the present disclosure.

As shown in FIG. 4 or the like, to an outer face of each upper side end plate 33 of the upper frame part 31, a heater attachment plate 35 is fixed. To an inner face of each upper side end plate 33, a belt attachment base 36 is fixed. An arc-like belt supporting part 37 is arranged at an end part inside in the front and rear direction of each belt attachment base 36. Around outer circumference of the belt supporting part 37, annular meandering restriction ring 38 is arranged.

To the top plate 34 of the upper frame part 31, a pair of front and rear first thermistors 40 are fixed. As shown in FIG. 3 or the like, each first thermistor 40 comes into contact with a center part and a rear part of an outer circumference face of the fixing belt 22.

The lower frame part 32 of the fixing frame 21 includes a pair of front and rear lower side end plates 41 and a bottom plate 42 connecting lower parts of the lower side end plates 41.

At an inside in the front and rear direction of each lower side end plate 41 of the lower frame part 32, swing frames 43 are arranged. At a right end side of each swing frame 43, a spindle 44 is arranged and each swing frame 43 is configured to swing around each spindle 44 as a fulcrum. At a rear side (outside in the front and rear direction) of the rear lower side end plate 41, an input gear 45 is arranged coaxially with each spindle 44. The input gear 45 is connected to a drive source 46 composed of a motor or the like.

As shown in FIG. 2 or the like, to the lower frame part 32, a second thermistor 47 is fixed. The second thermistor 47 comes into contact with an outer circumference face of the pressuring roller 23. At the lower frame part 32, an entry guide 48 and an ejecting guide 49 is arranged.

The fixing belt 22 is formed in a roughly cylindrical shape elongated in the front and rear direction. The fixing belt 22 has flexibility and is formed in an endless shape in a circumferential direction. The fixing belt 22 includes, for example, a base material layer and a release layer covering the base material layer. The base material layer of the fixing belt 22 is made of, for example, metal, such as steel special use stainless (SUS). Incidentally, the base material layer of the fixing belt 22 may be made of resin, such as polyimide (PI). The release layer of the fixing belt 22 is made of, for example, perfluoro alkoxy alkane (PFA) tube. Each figure shows the respective layers (the base material layer and the release layer) of the fixing belt 22 without especially distinguishing.

Into both front and rear end parts of the fixing belt 22, the belt supporting part 37 (refer to FIG. 4 or the like) arranged at each belt attachment base 36 of the upper frame part 31 is inserted. Thereby, the fixing belt 22 is rotatably supported by the upper frame part 31. The fixing belt 22 is rotatable around a rotation axis A (refer to FIG. 4 or the like) extending in the front and rear direction. That is, in the present embodiment, the front and rear direction is a rotation axis direction of the fixing belt 22. Both front and rear end faces of the fixing belt 22 are arranged at an inside in the front and rear direction of the meandering restriction ring 38 arranged in each belt attachment base 36 of the upper frame part 31. Thereby, meandering (movement to an outside in the front and rear direction) of the fixing belt 22 is restricted.

The pressuring roller 23 (refer to FIG. 2 or the like) is formed in a roughly columnar shape elongated in the front and rear direction. The pressuring roller 23 is composed of, for example, a columnar core material 50, an elastic layer 51 provided around the core material 50 and a release layer (not shown) covering the elastic layer 51. The core material 50 of the pressuring roller 23 is made of, for example, metal, such as iron. The elastic layer 51 of the pressuring roller 23 is made of, for example, silicone rubber. The release layer (not shown) of the pressuring roller 23 is made of, for example, PFA tube.

The pressuring roller 23 is arranged at a lower side (an outside) of the fixing belt 22. The pressuring roller 23 comes into pressure contact with the fixing belt and, between the fixing belt 22 and the pressuring roller 23, a fixing nip 52 is formed. Incidentally, the conveying direction of the sheet is, for example, a conveying direction when the sheet passes through the fixing nip 52. The pressuring roller 23 is rotatably supported by a center part in a longitudinal direction (in the present embodiment, a center part in the left and right direction) of each swing frame 43 of the fixing frame 21. Each swing frame 43 is configured to swing around each spindle 44 to move the pressuring roller 23 in the upper and lower direction so that the pressure of the fixing nip 52 is shifted.

As shown in FIG. 3, to a rear end part of the pressuring roller 23, a drive gear 53 is fixed. The drive gear 53 is meshed with the input gear 45 and connected to the drive source 46 via the input gear 45.

Figure 5:
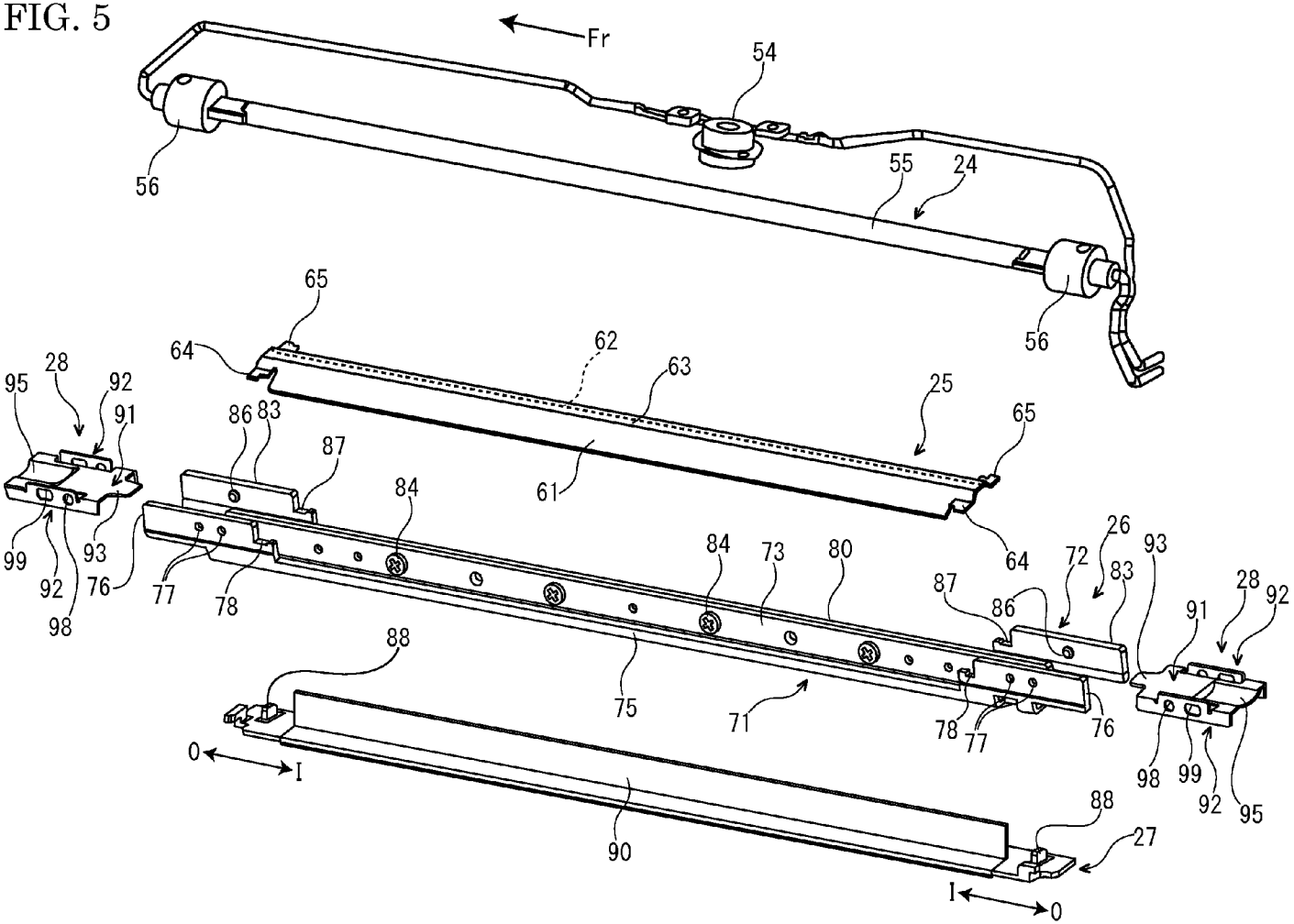
FIG. 5 is an exploded perspective view showing a heater, a reflecting member, a supporting member, a pressing member and a retaining member, in the fixing device of the printer according to the embodiment of the present disclosure.

The heater 24 (refer to FIG. 5 or the like) is composed of, for example, a halogen heater. As shown in FIG. 2 or the like, a lower end part (an end part of the fixing nip 52 side) of the heater 24 is arranged at an upper side (a further side from the fixing nip 52) than upper end parts (end parts far from fixing nip 52 side) of the pressing member 27, the supporting member 26 and the reflecting member 25. Both front and rear end parts of the heater 24 are attached to the heater attachment plate (refer to FIG. 4) of the upper frame part 31 of the fixing frame 21. As shown in FIG. 5 or the like, both front and rear end parts of the heater 24 are connected with a thermostat 54.

The heater 24 includes a radiating part 55 and held parts 56 arranged at both front and rear sides (outsides in the front and rear direction) of the radiating part 55. The radiating part 55 is configured to generate heat by energizing of the heater 24 so as to radiate a radiant heat. The held parts 56 are arranged at both front and rear end parts of the heater 24. Each held part 56 is formed in a lateral columnar shape and has a larger diameter than the radiating part 55.

The reflecting member 25 is formed in a shape elongated in the front and rear direction. The reflecting member 25 is made of a metal, such as an aluminum alloy for brightening. The reflecting member 25 is arranged between the heater 24 and the supporting member 26. A top face of the reflecting member 25 (a face at a side of the heater 24) is a reflecting face (mirror face) which reflects a radiant heat radiated from the radiating part 55 of the heater 24, to an inner circumference face of the fixing belt 22. The reflecting member 25 is arranged to cover an upper side (the side of the heater 24) of the supporting member 26, thereby preventing the radiant heat radiated from the radiating part 55 of the heater 24 from being directly radiated on the supporting member 26 so as to prevent the temperature of the supporting member 26 from rising.

As shown in FIG. 2 or the like, the reflecting member 25 includes a first reflecting part 61, a second reflecting part 62 which is provided at a left side (a downstream side in the sheet conveying direction) of the first reflecting part 61 and a third reflecting part 63 which connects the first reflecting part 61 with the second reflecting part 62.

The first reflecting part 61 inclines to a lower side (a side of the supporting member 26) toward a right side (an upstream side in the sheet conveying direction). The second reflecting part 62 inclines to a lower side (the side of the supporting member 26) toward a left side (the downstream side in the sheet conveying direction). The third reflecting part 63 is arranged along the left and right direction (the sheet conveying direction). The third reflecting part 63 faces the radiating part 55 of the heater 24 at an interval.

The reflecting member 25 is bent so as to project toward an upper side (a side of the heater 24). In other words, the reflecting member 25 is bent so as to dent toward a lower side (a side of the supporting member 26). Hence, at a lower side (a side of the supporting member 26) of the reflecting member 25, a concave part 66 is formed so as to be covered by the first reflecting part 61, the second reflecting part 62 and the third reflecting part 63.

As shown in FIG. 5 or the like, at both front and rear end parts of the first reflecting part 61, engagement pieces 64 extending horizontally toward a right side (the upstream side in the sheet conveying direction) are arranged. At both front and rear end parts of the second reflecting part 62, engagement pieces 65 extending horizontally toward a left side (the downstream side in the sheet conveying direction) are arranged.

The supporting member 26 is formed in a shape elongated in the front and rear direction. The supporting member 26 includes an upstream side stay 71 and a downstream side stay 72. The upstream side stay 71 and the downstream side stay 72 are made of sheet metals, such as SECC (galvanized steel sheet), for example. An upper part of the supporting member 26 is inserted into the concave part 66 formed at the lower side of the reflecting member 25.

Figure 6:
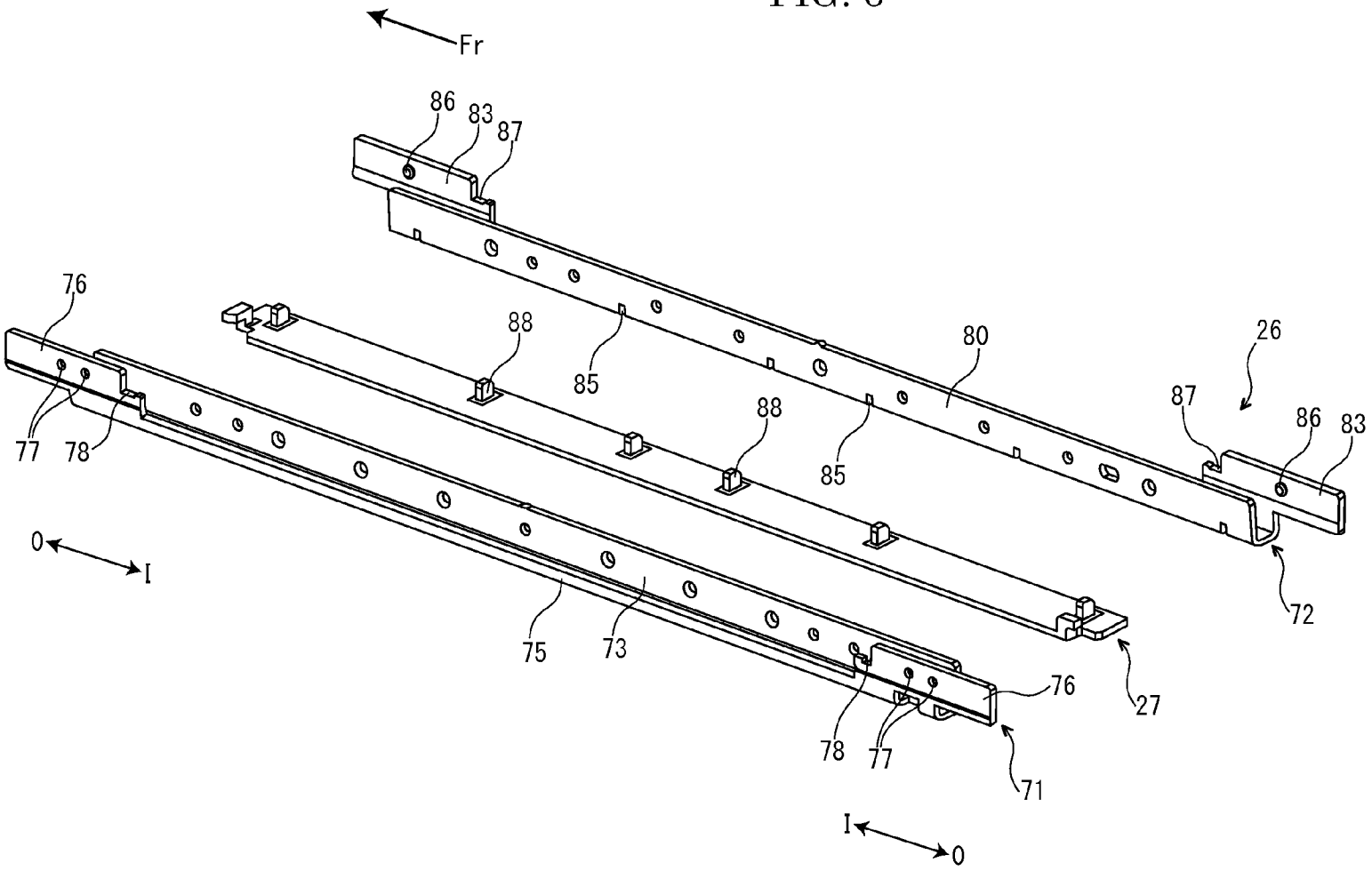
FIG. 6 is an exploded perspective view showing the supporting member and the pressing member, in the fixing device of the printer according to the embodiment of the present disclosure.
Figure 7:
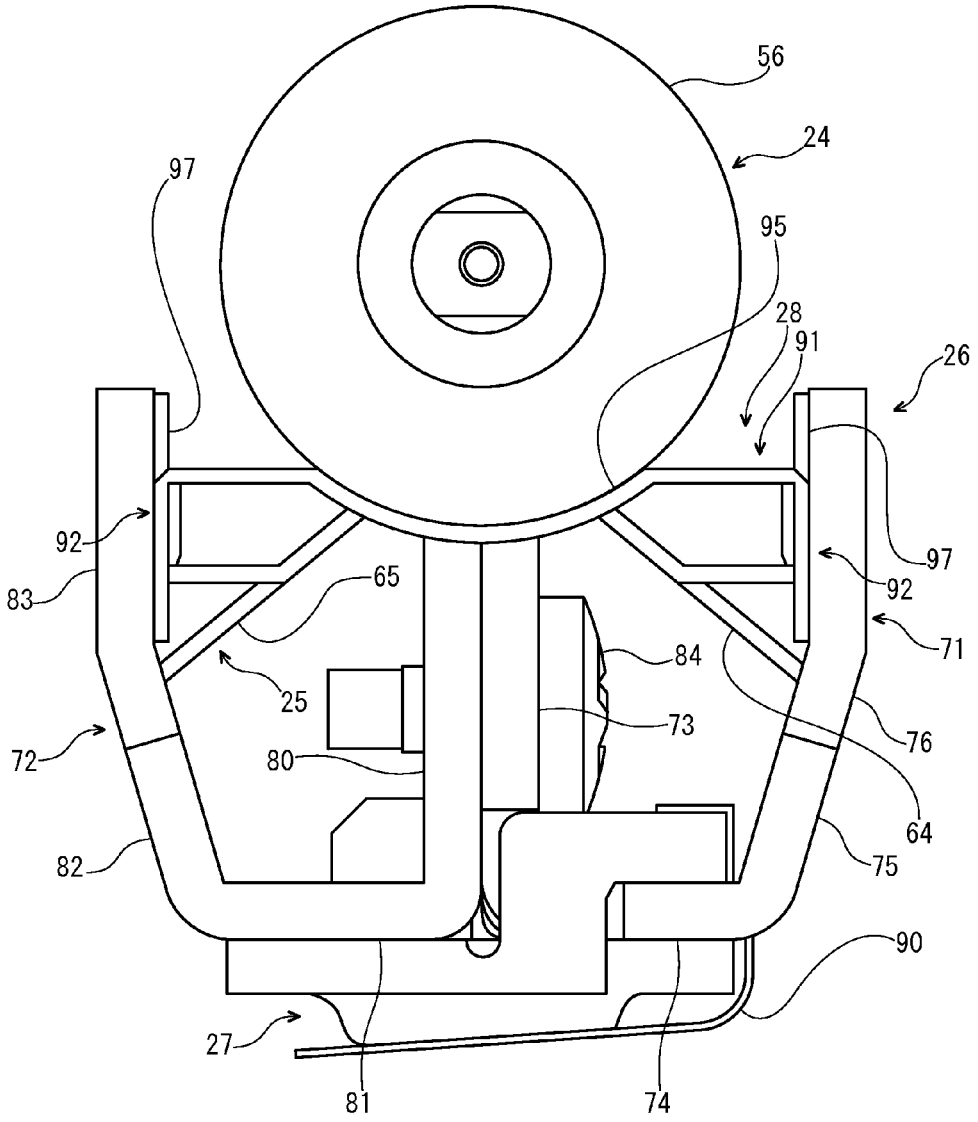
FIG. 7 is a front view showing the heater, the reflecting member, the supporting member, the pressing member and the retaining member, in the fixing device of the printer according to the embodiment of the present disclosure.

As shown in FIGS. 5 to 7 or the like, the upstream side stay 71 includes an upstream side base plate 73 which extends in upper and lower direction, an upstream side support plate 74 which is bent from a lower end part of the upstream side base plate 73 to the right side (the upstream side in the sheet conveying direction), an upstream side guide plate 75 which is bent from a right end part of the upstream side support plate 74 to an upper right side and upstream side fixing pieces 76 protruded from both front and rear end parts of the upstream side guide plate 75 to an upper side and extending toward outsides in the front and rear direction.

In a left side face (an inside face in the left and right direction) of each upstream side fixing piece 76, a pair of front and rear fixing protrusions 77 are arranged. At an inside end part of each upstream side fixing piece 76 in the front and rear direction, an engagement groove 78 (an engagement part) is arranged.

As shown in FIGS. 5 to 7 or the like, the downstream side stay 72 includes a downstream side base plate 80 which extends in the upper and lower direction, a downstream side support plate 81 which is bent from a lower end part of the downstream side base plate 80 to the left side (the downstream side in the sheet conveying direction), a downstream side guide plate 82 which is bent from a left end part of the downstream side support plate 81 to an upper left side and downstream side fixing pieces 83 protruded from both front and rear end parts of the downstream side guide plate 82 to an upper side and extending toward outsides in the front and rear direction.

The downstream side base plate 80 is fixed to the upstream side base plate 73 with a plurality of screws 84 arranged at intervals in the front and rear direction. At a lower end part of the downstream side base plate 80, a plurality of fitting holes 85 are arranged at intervals in the front and rear direction.

In a right side face (an inside face in the left and right direction) of each downstream side fixing piece 83, a fixing protrusion 86 is arranged. At an inside end part of each downstream side fixing piece 83 in the front and rear direction, an engagement groove 87 (an engagement part) is arranged.

Figure 8:
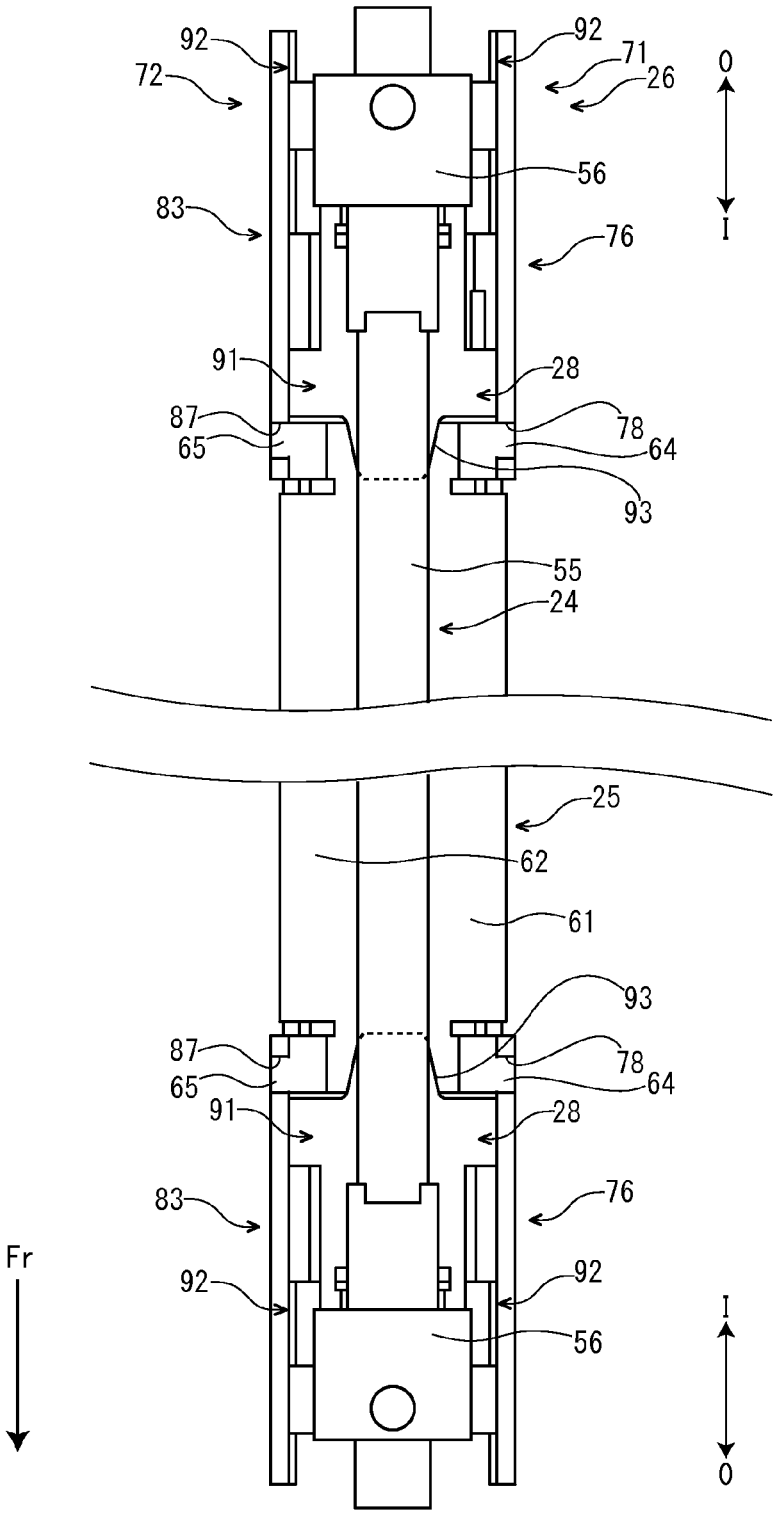
FIG. 8 is a plan view showing the heater, the reflecting member, the supporting member and the retaining member, in the fixing device of the printer according to the embodiment of the present disclosure.
Figure 9:
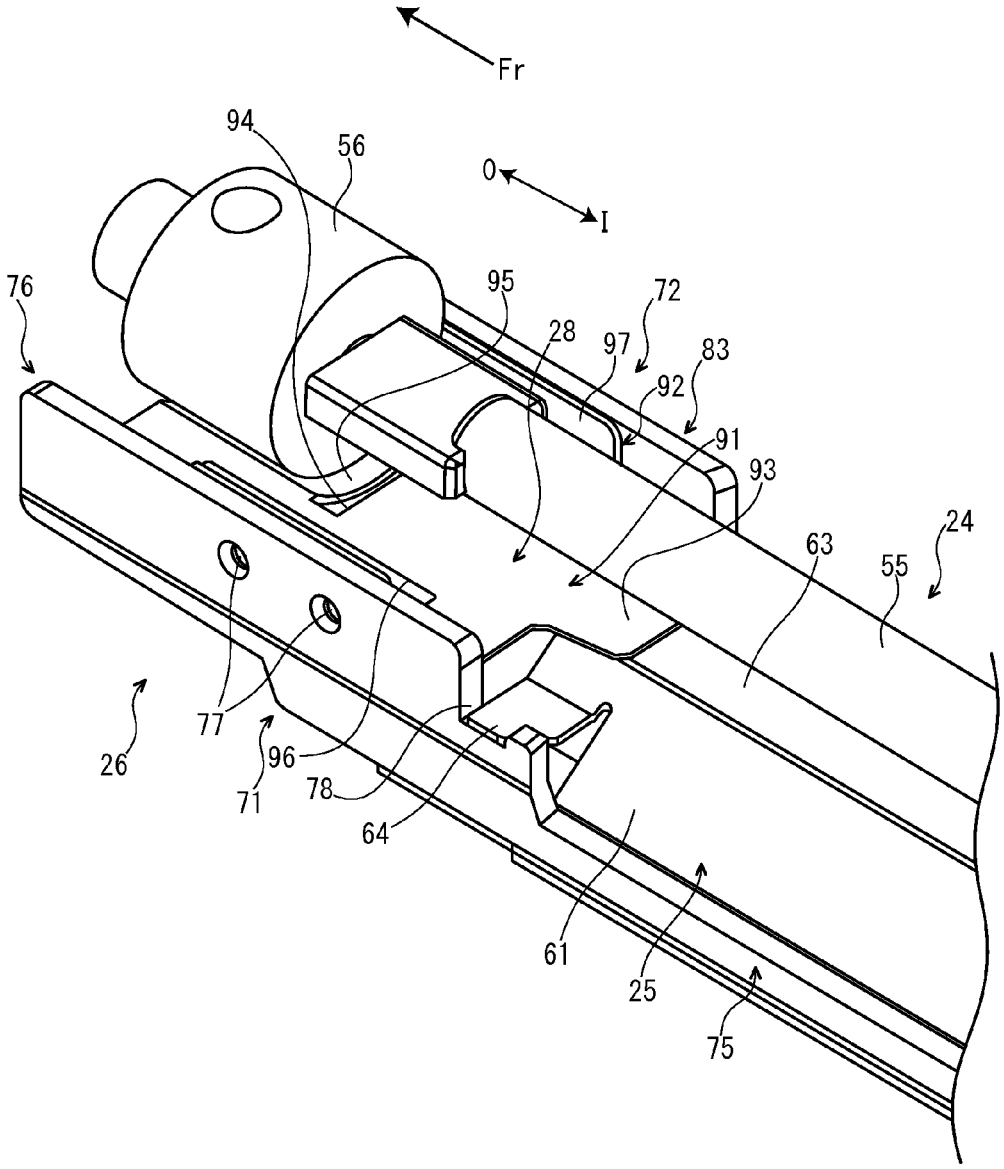
FIG. 9 is a perspective view showing the heater, the reflecting member, the supporting member and the retaining member, in the fixing device of the printer according to the embodiment of the present disclosure.

As shown in FIGS. 8 and 9 or the like, with the engagement grooves 78, 87 arranged at the upstream side stay 71 and the downstream side stay 72, the engagement pieces 64, 65 arranged at the first reflecting part 61 and the second reflecting part 62 of the reflecting member 25 are engaged. By such a configuration, the reflecting member 25 is supported by the supporting member 26 from a lower side (a side of the fixing nip 52).

As shown in FIG. 6 or the like, the pressing member 27 is formed in a plate-like shape elongated in the front and rear direction. The pressing member 27 is made of a heat resistant resin such as LCP (Liquid Crystal Polymer).

In an upper face of the pressing member 27, a plurality of fitting protrusions 88 are arranged at intervals in the front and rear direction. Each fitting protrusion 88 fits into each fitting hole 85 arranged at the downstream side base plate 80 of the downstream side stay 72 of the supporting member 26.

As shown in FIG. 7 or the like, a top face of the pressing member 27 comes into contact with a bottom face of the supporting member 26 (more specifically, the bottom face of the upstream side support plate 74 of the upstream side stay 71 and the bottom face of the downstream side support plate 81 of the downstream side stay 82). Thus, the pressing member 27 is supported by the supporting member 26, and a warp (deformation caused by a fixing load) of the pressing member 27 is suppressed.

As shown in FIG. 2 or the like, the bottom face of the pressing member 27 inclines to a lower side (a side of the pressuring roller 23) from the right side (the upstream side in the sheet conveying direction) toward the left side (the downstream side in the sheet conveying direction). The bottom face of the pressing member 27 presses the fixing belt 22 to the lower side (the side of the pressuring roller 23).

Between the bottom face of the pressing member 27 and the inner circumference face of the fixing belt 22, a sheet member 90 is interposed. The sheet member 90 is made of a fluorine-based resin, such as PTFE, and has a lower friction coefficient than that of the pressing member 27. In addition, between the bottom face of the pressing member 27 and the inner circumference face of the fixing belt 22, a lubricant (grease) may be applied.

Figure 10:
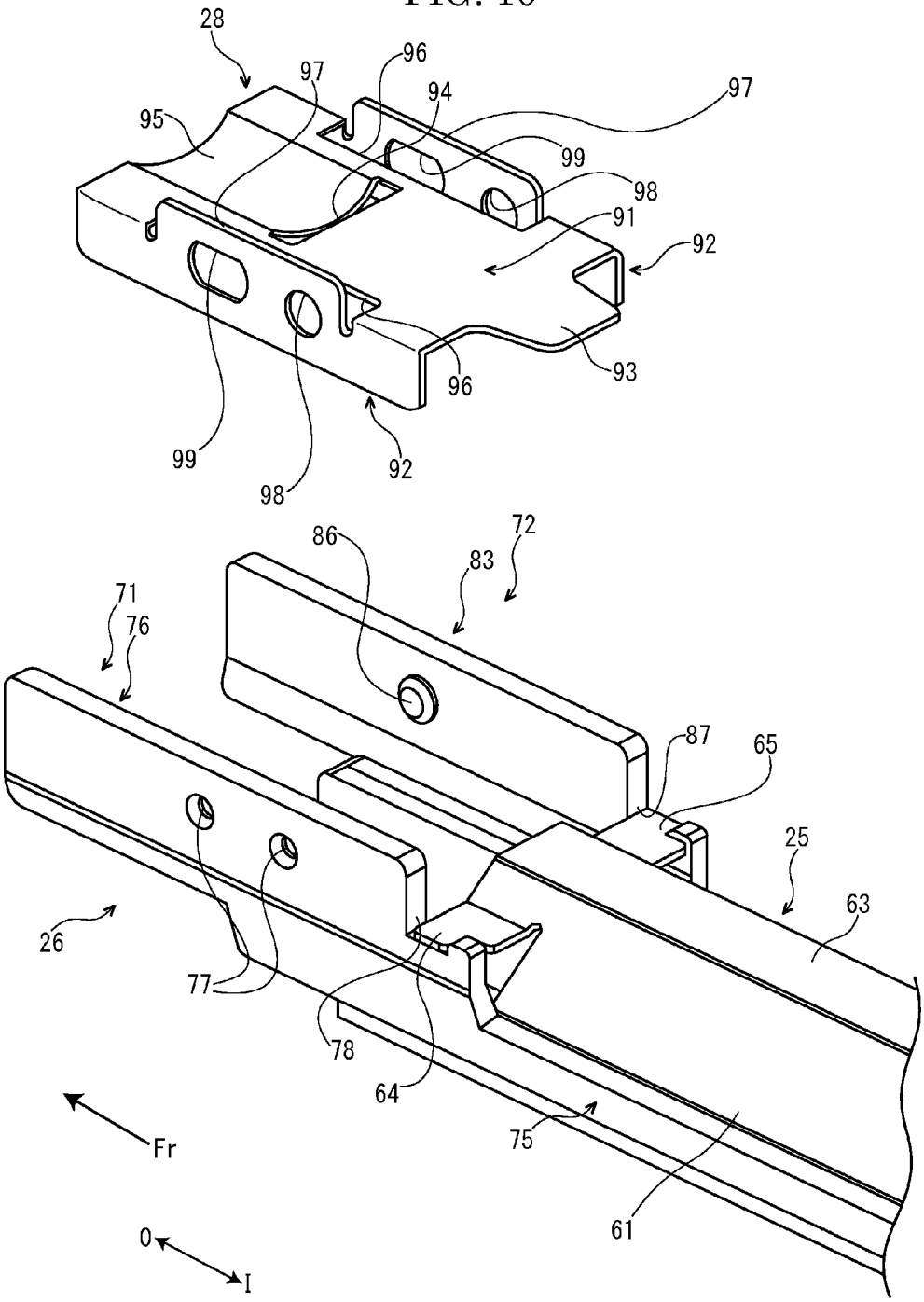
FIG. 10 is an exploded perspective view showing the reflecting member, the supporting member and the retaining member, in the fixing device of the printer according to the embodiment of the present disclosure.

As shown in FIGS. 9 and 10 or the like, each retaining member 28 includes a main body plate 91 and both side plates 92 arranged at both left and right sides of the main body plate 91.

The main body plate 91 of each retaining member 28 extends in a horizontal direction. At an inside end part of the main body plate 91 in the front and rear direction (a first end part in the front and rear direction), a roughly rectangular contact part 93 is arranged. The contact part 93 is protruded from a center in the left and right direction of an inside edge part of the main body plate 91 in the front and rear direction toward an inside in the front and rear direction. The contact part 93 comes into contact with each of both front and rear end parts of the third reflecting part 63 of the reflecting member 25 from an upper side (a side opposite to the fixing nip 52). As shown in FIG. 8 or the like, the contact part 93 overlaps partially with the engagement grooves 78, 87 of the supporting member 26 with regard to a location in the front and rear direction.

As shown in FIGS. 9 and 10 or the like, in the center part of the main body plate 91 in the front and rear direction, a notch part 94 formed in a rectangular shape by a plan view is arranged. At an outside end part of the main body plate 91 in the front and rear direction (a second end part in the front and rear direction), a holding part 95 is arranged at an outside of the notch part 94 in the front and rear direction. The holding part 95 is curved in an arc shape to a lower side (a side of the fixing nip 52). On the holding part 95, each held part 56 of the heater 24 is placed (held). At both left and right edge parts of the main body plate 91, rectangular slits 96 are arranged.

Each side plate 92 of each retaining member 28 is bent from each of the both left and right edge parts of the main body plate 91 to a lower side. At each side plate 92, a protruding piece 97 protruding upward is arranged from a front part to a rear part.

At an inside part of each side plate 92 in the front and rear direction, a first fixing hole 98 with a precise circular shape is arranged so as to overlap partially with the protruding piece 97. With the first fixing hole 98 of the right side plate 92, the fixing protrusion 77 arranged at an inside in the front and rear direction of the upstream side stay 71 of the supporting member 26 is engaged. At an outside part of each side plate 92 in the front and rear direction, a second fixing hole 99 with an elongated hole shape elongated in a lateral direction is arranged so as to overlap partially with the protruding piece 97. With the second fixing hole 99 of the right side plate 92, the fixing protrusion 77 arranged at an outside in the front and rear direction of the upstream side stay 71 of the supporting member 26 is engaged. With the second fixing hole 99 of the left side plate 92, the fixing protrusion 86 of the downstream side stay 72 of the supporting member 26 is engaged. By above-mentioned configuration, each side plate 92 is fixed to the supporting member 26.

To fix a toner image to a sheet in the fixing device 18 to which the above configuration is applied, the drive source 46 is driven. When the drive source 46 is driven in this way, a rotation of the drive source 46 is transmitted to the pressuring roller 23 via the input gear 45 and the drive gear 53, and the pressuring roller 23 rotates as indicated by arrow B in FIG. 2. When the pressuring roller 23 rotates in this way, as indicated by arrow C in FIG. 2, the fixing belt 22 which comes into pressure contact with the pressuring roller 23 is driven and rotated in a direction opposite to that of the pressuring roller 23. When the fixing belt 22 rotates in this way, the fixing belt 22 slides against the pressing member 27 and the sheet member 90.

Further, to fix a toner image to a sheet, the heater 24 is activated (turned on). When the heater 24 is activated in this way, the radiating part 55 of the heater 24 radiates a radiant heat. As indicated by arrow D in FIG. 2, a part of the radiant heat radiated from the radiating part 55 of the heater 24 is directly radiated on the inner circumference face of the fixing belt 22, and is absorbed. Further, as indicated by arrow E in FIG. 2, another part of the radiant heat radiated from the radiating part 55 of the heater 24 is reflected to the inner circumference face of the fixing belt 22 by the upper face of the reflecting member 25 and is absorbed by the inner circumference face of the fixing belt 22. According to the above function, the heater 24 heats the fixing belt 22. When a sheet passes through the fixing nip 52 in this state, a toner image is heated and then melts, and then the toner image is fixed to the sheet.

In the present embodiment, as described above, a manner to directly heat the fixing belt 22 by the heater 24 is applied. However, it is impossible to directly heat the fixing belt 22 by the heater 24 in an area where the reflecting member 25 and the supporting member 26 exist (an area of a side of the fixing nip 52). Accordingly, there is a problem that heating efficiency of the fixing belt 22 is deteriorated.

However, in the present embodiment, the reflecting member 25 is provided with the first reflecting part 61 and the second reflecting part 62 so that the reflecting member 25 is formed in a shade-like shape, and a center part in the left and right direction (the upstream side base plate 73 and the downstream side base plate 80) of the supporting member 26 is made higher than both left and right side parts (the upstream side guide plate 75 and the downstream side guide plate 82) of the supporting member 26 (refer to FIG. 2 or the like). By applying such a configuration, it is possible to broaden an area, of the fixing belt 22, directly heated by the heater 24. Accordingly, it is possible to rise the heating efficiency of the fixing belt 22.

Also, the reflecting member 25 further includes the third reflecting part 63 configured to connect the first reflecting part 61 with the second reflecting part 62. Accordingly, it is possible to easily separate the heater 24 from the reflecting member 25, thereby preventing the temperature of the reflecting member 25 from rising.

On the other hand, if the center part in the left and right direction of the supporting member 26 is made higher than the both left and right side parts of the supporting member 26 as described above, it becomes difficult to place the heater 24 on the supporting member 26 because the parts of the same height in an upper face of the supporting member 26 is reduced. Accompanying to this, there is a concern that it becomes difficult to assemble the fixing device 18. Accordingly, in the present embodiment, the fixing device 18 is assembled in the following way.

Firstly, the reflecting member 25 is placed on the supporting member 26 while the engagement pieces 64, of the reflecting member 25 are engaged with the engagement grooves 78, 87 of the supporting member 26. Next, the fixing protrusions 77, 86 of the supporting member 26 are engaged with the first and second fixing holes 98, 99 of each side plate 92 of each retaining member 28. According to this, each side plate 92 is fixed to the supporting member 26 and each retaining member 28 is attached to each of both front and rear end parts of the supporting member 26. Accompanying to this, the contact part 93 of each retaining member 28 comes into contact with each of both front and rear end parts of the third reflecting part 63 of the reflecting member 25 from the upper side. According to this, a shift of the reflecting member 25 is securely prevented.

Next, each held part 56 of the heater 24 is placed on the holding part 95 of each retaining member 28. In this state, the heater 24, the reflecting member 25, the supporting member 26 and the pressing member 27 are inserted into the fixing belt 22.

In the present embodiment, as described above, each held part 56 of the heater 24 is placed (held) on the holding part 95 of each retaining member 28 when the fixing device 18 is assembled. Accordingly, it is possible to easily assemble the fixing device 18.

Also, in the fixing device 18 with above-mentioned configuration, if the reflecting member 25 and the supporting member 26 are fastened to each other with a screw, there is a concern that the reflecting member 25 which is weaker than the supporting member 26 is deformed when they are heated because of the difference between a linear expansion coefficient of the reflecting member 25 and that of the supporting member 26. Thus, in the present embodiment, the reflecting member 25 is supported by the supporting member 26 from the lower side (the side of the fixing nip 52) and the contact part 93 of each retaining member 28 comes into contact with each of both front and rear end parts of the third reflecting part 63 of the reflecting member 25 from an upper side (the side opposite to the fixing nip 52). By applying such a configuration, it is possible to sandwich the reflecting member 25 between the supporting member 26 and the contact part 93 and to fix the reflecting member 25 to the supporting member 26 without fastening the reflecting member 25 to the supporting member 26 with a screw. Accordingly, it is possible to prevent the reflecting member 25 from deforming when the reflecting member 25 and the supporting member 26 are heated.

Also, each retaining member 28 includes a main body plate 91 including the contact part 93 and the holding part 95 and the both side plates 92 arranged at both sides of the main body plate 91, and the both side plates 92 are fixed to the supporting member 26. By applying such a configuration, it is possible to securely fix each retaining member 28 to the supporting member 26.

Also, the contact part 93 is arranged at the inside end part of the main body plate 91 in the front and rear direction and the holding part 95 is arranged at the outside end part of the main body plate 91 in the front and rear direction. By applying such a configuration, it is possible to separate the contact part 93 which comes into contact with the third reflecting part 63 of the reflecting member 25 from the holding part 95 on which each held part 56 of the heater 24 is placed (held), as far as possible. Accompanying to this, it is possible to prevent the reflecting member 25 and the heater 24 from coming into contact with each other when the fixing device 18 is assembled.

Also, the supporting member 26 includes the engagement grooves 78, 87 with which the engagement pieces 64, 65 of the reflecting member 25 are engaged, and the contact part 93 overlaps partially with the engagement grooves 78, 87 with regard to the location in the front and rear direction. By applying such a configuration, it is possible to sandwich the reflecting member 25 between the engagement grooves 78, 87 and the contact part 93. Accordingly, it is possible to securely prevent the shift of the reflecting member 25.

Also, the heater 24 includes the radiating part 55 configured to radiate the radiant heat and the held parts 56 arranged at the outsides of the radiating part 55 in the front and rear direction and placed on the holding part 95. By applying such a configuration, it is possible to prevent a temperature of each retaining member 28 from rising due to heat transmission from the heater 24, compared with a case where the radiating part 55 is placed on the holding part 95.

Also, each held part 56 is formed in the lateral columnar shape and the holding part 95 is curved in the arc shape to the lower side. By applying such a configuration, it is possible to securely hold each held part 56 by the holding part 95.

Also, the fixing device 18 includes a pressing member 27 configured to press the fixing belt 22 to the lower side (the side of the pressuring roller 23). By applying such a configuration, it is possible to securely fix the toner image onto the sheet in the fixing nip 52.

Also, in the present embodiment, the heater 24 heats the fixing belt 22, so that it is possible to reduce a heat capacity of a member heated by the heater 24, compared with a case where the heater 24 heats a fixing roller. Accompanying to this, it is possible to shorten a warm-up time of the fixing device 18.

Also, in the present embodiment, the reflecting member 25 is bent so as to project to the upper side (the side of the heater 24), so that it is possible to broaden the area, of the fixing belt 22, directly heated by the heater 24. Accordingly, it is possible to promptly rise the temperature of the fixing belt 22.

Also, in the present embodiment, the reflecting member 25 includes the third reflecting part 63, so that it is possible to easily separate the heater 24 from the reflecting member 25. Therefore, it is possible to prevent the temperature of the reflecting member 25 from rising. Also, the contact part 93 of each retaining member 28 comes into contact with the third reflecting part 63, so that it is possible to securely prevent the shift of the reflecting member 25.

Figure 11:
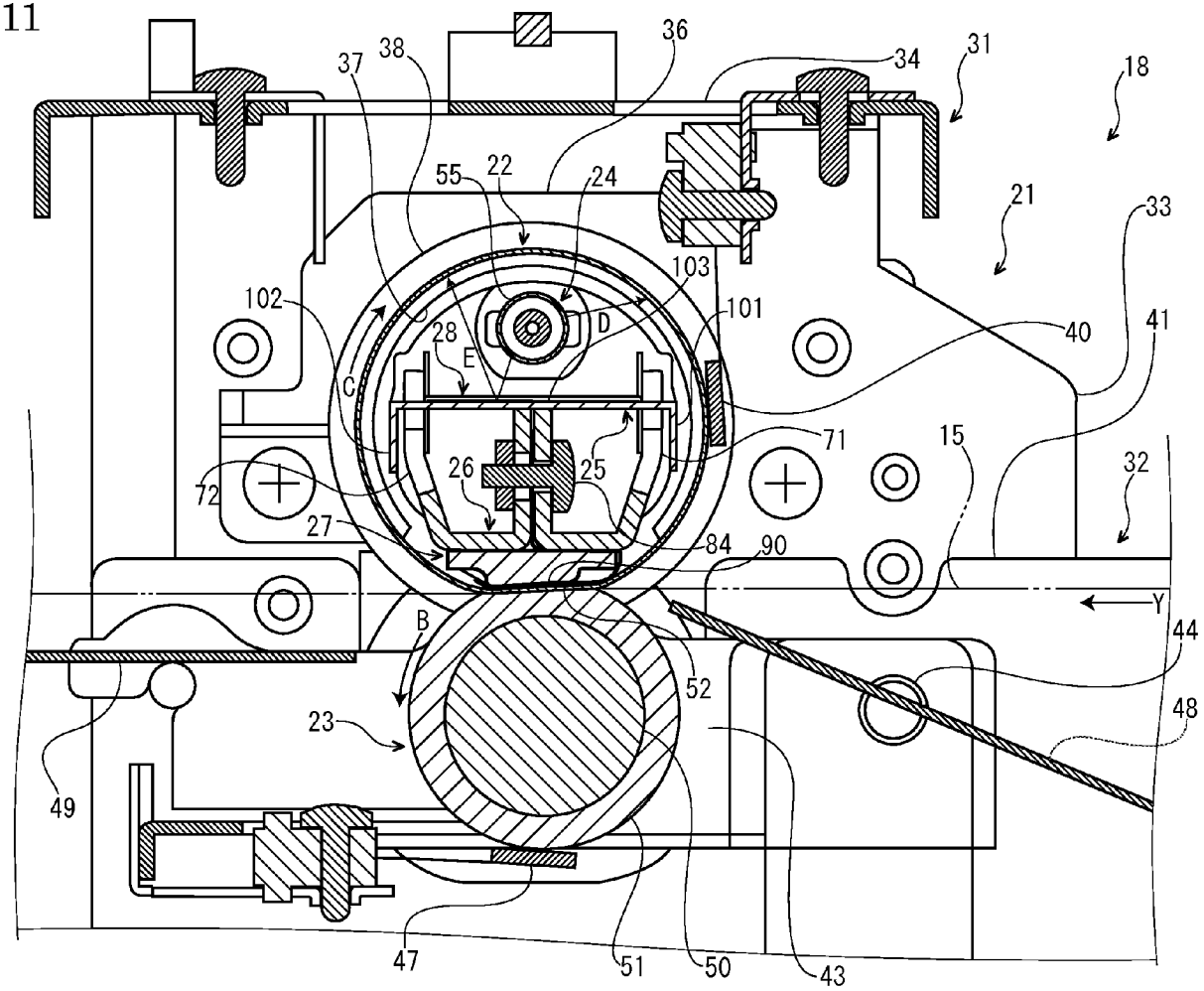
FIG. 11 is a sectional view showing a fixing device according to another embodiment of the present disclosure.

In the present embodiment, the reflecting member 25 is bent so as to project to the upper side (the side of the heater 24). In another embodiment, the reflecting member 25 may be curved so as to project to the upper side (the side of the heater 24). In still another embodiment, as shown in FIG. 11, the reflecting member 25 may include a first plate part 101 arranged along an upper and lower direction (a direction crossing (orthogonal) to the sheet conveying direction) and arranged at a right side (an upstream side in the sheet conveying direction) of the supporting member 26, a second plate part 102 arranged along the upper and lower direction (the direction crossing (orthogonal) to the sheet conveying direction) and arranged at a left side (a downstream side in the sheet conveying direction) of the supporting member 26 and a third plate part 103 configured to connect upper end parts (end parts of a side far from the fixing nip 52) of the first plate part 101 and the second plate part 102. By applying such a configuration, the reflecting member 25 may be formed in a U shape, thereby making a large space at a lower side (a side of the supporting member 26) of the reflecting member 25. Accompanying to this, it is possible to enhance flexibility of a layout of the supporting member 26.

In the present embodiment, the first reflecting part 61 and the second reflecting part 62 of the reflecting member 25 are connected by the third reflecting part 63. In another embodiment, the first reflecting part 61 and the second reflecting part 62 of the reflecting member 25 may be directly connected with each other without the third reflecting part 63. In such a case, the reflecting member 25 may be formed in a roughly V shape and it is preferable to form the contact part 93 of each retaining member 28 in a V shape so that the form of the contact part 93 corresponds to that of the reflecting member 25. By applying such a configuration, it is possible to securely prevent the shift of the reflecting member 25.

In the present embodiment, one heater 24 is arranged at the inside in the radial direction of the fixing belt 22. In another embodiment, a plurality of heaters 24 may be arranged at the inside in the radial direction of the fixing belt 22.

In the present embodiment, the halogen heater is used as the heater 24. In another embodiment, a ceramic heater or the like may be used as the heater 24.

In the present embodiment, the configuration of the present disclosure is applied to the printer 1. In another embodiment, the configuration of the present disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt configured to be rotatable around a rotation axis;

a pressuring member configured to be rotatable and to come into pressure contact with the fixing belt so as to form a fixing nip;

a heat source arranged at an inside in a radial direction of the fixing belt and configured to radiate a radiant heat;

a reflecting member configured to reflect the radiant heat radiated from the heat source to an inner circumference face of the fixing belt;

a supporting member configured to support the reflecting member from a side of the fixing nip; and a retaining member including:

a contact part configured to come into contact with the reflecting member from a side opposite to the fixing nip; and a holding part configured to hold the heat source, wherein the reflecting member is arranged between the heat source and the supporting member and configured to be curved or bent so as to project to a side of the heat source, wherein the reflecting member includes:

a first reflecting part configured to incline to a side of the supporting member toward an upstream side in a conveying direction of a recording medium;

a second reflecting part arranged at a downstream side of the first reflecting part in the conveying direction of the recording medium and configured to incline to the side of the supporting member toward a downstream side in the conveying direction of the recording medium; and a third reflecting part arranged along the conveying direction of the recording medium and configured to connect the first reflecting part with the second reflecting part, and the contact part is configured to come into contact with the third reflecting part.

2. The fixing device according to claim 1, wherein the retaining member includes:

a main body plate including the contact part and the holding part; and both side plates arranged at both sides of the main body plate, and the both side plates are fixed to the supporting member.

3. The fixing device according to claim 2, wherein the contact part is arranged at a first end part of the main body plate in a direction of the rotation axis, and the holding part is arranged at a second end part of the main body plate in the direction of the rotation axis.

4. The fixing device according to claim 1, wherein the supporting member includes an engagement part with which an end part of the reflecting member in a direction of the rotation axis is engaged, and the contact part is configured to overlap at least partially with the engagement part with regard to a location in the direction of the rotation axis.

5. The fixing device according to claim 1, wherein the heat source includes:

a radiating part configured to radiate the radiant heat; and a held part arranged at an outside of the radiating part in a direction of the rotation axis and placed on the holding part.

6. The fixing device according to claim 5, wherein the held part is formed in a lateral columnar shape, and the holding part is curved in an arc shape to a lower side.

7. The fixing device according to claim 1, further comprising a pressing member configured to be supported by the supporting member and to press the fixing belt to a side of the pressuring member.

8. The fixing device according to claim 1, wherein the contact part is configured to be protruded from an inside edge part of the retaining member in a direction of the rotation axis toward an inside in the direction of the rotation axis.

9. The fixing device according to claim 1, wherein a notch part is arranged at a center part of the retaining member in a direction of the rotation axis, and the holding part is arranged at an outside of the notch part in the direction of the rotation axis.

10. An image forming apparatus comprising the fixing device according to claim 1.

* * * * *